US008817056B2

(12) United States Patent
Park

(10) Patent No.: US 8,817,056 B2
(45) Date of Patent: Aug. 26, 2014

(54) LIQUID CRYSTAL DISPLAY WITH DYNAMIC BACKLIGHT CONTROL

(75) Inventor: Jong-Woong Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 260 days.

(21) Appl. No.: 12/825,821

(22) Filed: Jun. 29, 2010

(65) Prior Publication Data

US 2011/0109658 A1 May 12, 2011

(30) Foreign Application Priority Data

Nov. 12, 2009 (KR) ..... 10-2009-0109021

(51) Int. Cl.
*G09G 5/10* (2006.01)

(52) U.S. Cl.
USPC ..... 345/690; 345/88; 345/102

(58) Field of Classification Search
CPC ..... G09G 5/10; G09G 3/36; G09G 3/2007
USPC ..... 345/88, 102, 590, 690, 694; 382/232
See application file for complete search history.

(56) References Cited

U.S. PATENT DOCUMENTS

| | | | | |
|---|---|---|---|---|
| 7,295,178 | B2 * | 11/2007 | Nakano et al. | 345/98 |
| 2005/0083352 | A1 | 4/2005 | Higgins | |
| 2005/0225574 | A1 | 10/2005 | Brown Elliott et al. | |
| 2006/0087484 | A1 | 4/2006 | Kumeta et al. | |
| 2006/0244686 | A1 | 11/2006 | Higgins et al. | |
| 2006/0262059 | A1 * | 11/2006 | Hashimoto et al. | 345/89 |
| 2007/0024557 | A1 | 2/2007 | Rho et al. | |
| 2007/0279372 | A1 * | 12/2007 | Brown Elliott et al. | 345/102 |
| 2009/0009495 | A1 | 1/2009 | Jeon et al. | |
| 2009/0027425 | A1 * | 1/2009 | Park et al. | 345/690 |
| 2009/0085924 | A1 * | 4/2009 | Ben-Chorin et al. | 345/591 |
| 2009/0122073 | A1 | 5/2009 | Higgins et al. | |
| 2009/0128456 | A1 * | 5/2009 | Lee | 345/63 |
| 2009/0146914 | A1 * | 6/2009 | Seong et al. | 345/6 |
| 2009/0207120 | A1 | 8/2009 | Lin | |

FOREIGN PATENT DOCUMENTS

| | | | |
|---|---|---|---|
| CN | 200997685 | Y | 12/2007 |
| CN | 101191965 | A | 6/2008 |
| CN | 100447854 | C | 12/2008 |
| KR | 1020070121163 | A | 12/2007 |
| KR | 10-2008-0053647 | A | 6/2008 |

(Continued)

OTHER PUBLICATIONS

Korean Office action dated Mar. 23, 2011 for corresponding Korean Patent Application No. 10-2009-0109021, 4pp.

(Continued)

*Primary Examiner* — Andrew Sasinowski
(74) *Attorney, Agent, or Firm* — Christie, Parker & Hale, LLP

(57) ABSTRACT

A liquid crystal display (LCD) capable of converting input RGB data into RGBW data to provide the RGBW data to a panel. The LCD simultaneously controls the light level of a backlight and the amount of the RGBW data to prevent RGBW picture quality from being damaged in pure color data, minimizes the power consumption of the LCD, and applies the above to a CPU interface method as well as an RGB interface method.

13 Claims, 6 Drawing Sheets

(56) References Cited

FOREIGN PATENT DOCUMENTS

| | | | |
|---|---|---|---|
| KR | 10-2008-0059931 | A | 7/2008 |
| KR | 1020080064913 | A | 7/2008 |
| KR | 10-2009-0036513 | A | 4/2009 |
| KR | 10-2009-0040230 | A | 4/2009 |
| KR | 1020090036513 | A | 4/2009 |
| KR | 1020090040230 | A | 4/2009 |
| WO | WO 2008/035259 | A1 | 3/2008 |

OTHER PUBLICATIONS

KIPO Office action dated Nov. 29, 2011 corresponding to priority application 10-2009-0109021, 1 sheet.
European Patent Office Action dated Sep. 1, 2011 for corresponding application 10251924.6, 10 pages.
SIPO Office action dated Feb. 21, 2014, with English translation, for corresponding Chinese Patent application 201010266820.7, (17 pages).

* cited by examiner

| | | |
|---|---|---|
| | Rgma2 | |
| Rgma3 | Rgma1 | Rgma5 |
| | Rgma4 | |

LIQUID CRYSTAL DISPLAY WITH DYNAMIC BACKLIGHT CONTROL

CROSS-REFERENCE TO RELATED APPLICATION

This application claims priority to and the benefit of Korean Patent Application No. 10-2009-0109021, filed on Nov. 12, 2009, in the Korean Intellectual Property Office, the entire content of which is incorporated herein by reference.

BACKGROUND OF THE INVENTION

1. Field of the Invention

An embodiment of the present invention relates to a liquid crystal display (LCD), and more particularly, to a liquid crystal display (LCD) for performing dynamic backlight control for a pixel structure in an RGBW method and a method of driving the same.

2. Description of the Related Art

In general, a liquid crystal display (LCD) includes a liquid crystal display panel including a plurality of scan lines and a plurality of data lines, a gate driving circuit supplying gate driving signals to the plurality of scan lines, and a data driving circuit for supplying data signals to the plurality of data lines. The liquid crystal display panel includes a lower substrate on which a pixel electrode is formed, an upper substrate on which a common electrode is formed, and a liquid crystal layer inserted between the lower substrate and the upper substrate and applies a voltage to the electrodes to re-arrange the liquid crystal molecules of the liquid crystal layer and to control the transmittance of the light that passes through the liquid crystal layer. Red (R), green (G), and blue (B) pixels are formed in the liquid crystal panel and the pixels are driven by the signals applied to the scan lines and the data lines so that a display operation is performed.

As the resolution of the LCD increases, the aperture ratio of the liquid crystal panel is reduced so that its brightness deteriorates. In order to solve this problem, a pixel structure in a Pentile method is provided. In the pixel structure of the Pentile method, the blue unit pixel is shared when two dots are displayed. The data signals are transmitted to adjacent blue unit pixels by one data driving circuit, and the adjacent blue unit pixels are driven by different gate driving circuits. In addition, in order to improve brightness, the RGBW method in which a white (W) pixel is added to the red (R), green (G), and blue (B) pixels is provided.

Furthermore, in controlling the backlight included in the LCD, in order to reduce power consumption and to improve picture quality, a dynamic backlight control function is used.

SUMMARY

Various embodiments of the present invention are directed to a liquid crystal displays (LCDs) capable of converting input RGB data into RGBW data to provide the RGBW data to a panel, and controlling the light level of a backlight and the amount of the RGBW data to prevent RGBW picture quality from being deteriorated in pure color data, of minimizing the power consumption of the LCD, and of applying the above to a CPU interface method as well as an RGB interface method and a method of driving the same.

In some embodiments, the present invention is directed to a liquid crystal display (LCD) driven by a CPU interface method. The LCD includes a liquid crystal panel having a plurality of R, G, B, and W pixels located between a plurality of scan lines and data lines arranged in a matrix, a backlight unit for radiating light onto the liquid crystal panel, a data driver for applying data signals to the plurality of data lines, an image signal converter for converting RGB data input from the outside into RGBW data to provide the RGBW data to the data driver, and a dynamic backlight controller for controlling an amount of light emitted from the backlight unit to correspond to data applied to the RGBW pixel. A frame memory is provided in the image signal converter.

R, G, B, and W pixels are sequentially arranged in order in an odd row. B, W, R, and G pixels are sequentially arranged in order in an even row.

The image signal converter includes an input gamma processing unit for processing linear RGB data input to gamma shaped non-linear data, a gamma mapping unit for extracting a white value from the non-linear data to convert the RGB data into the RGBW data, an initial scaler for executing an initial scale value to be fixed as a specific value, a sub pixel rendering unit for matching the input RGB data with the RGBW data to assign converted data value to corresponding RGBW pixels, an output gamma processing unit for performing inverse gamma calculations with respect to the gamma shaped non-linear data, a frame memory for storing the inverse gamma RGBW data, and a scaler for performing scaling in accordance with a scale value corresponding to the data stored in the frame memory.

In some embodiments, a specific scale value fixed to an initial scale value by the initial scaler is a scale value of substantially 50%, which corresponds to a light level of a backlight of substantially 100%.

Colors that deviate from color areas are detected and the light level of the backlight is determined with respect to the data converted from the gamma mapping unit of the image signal converter in a previous stage of the frame memory. An operation of a scaler to which a real scale value is applied is performed in a stage before the frame memory.

In some embodiment, the dynamic backlight controller includes a data testing unit for detecting the colors that deviate from the color areas by the RGBW data converted by the gamma mapping unit, a BL decision/smoothing unit for outputting a backlight level correct signal to control the color mapping and outputting the scale value corresponding to the correct signal when colors are mapped in the out of color areas, and a backlight controller for receiving the backlight level correct signal determined by the BL decision/smoothing unit to control the backlight unit to correspond to the backlight level correct signal. The scale value is input to a scaler of the image signal converter.

In some embodiments, the present invention is directed to a method of driving an LCD driven by a CPU interface method. The method includes processing linear RGB data to generate gamma shaped non-linear data, extracting a white value from the non-linear data to convert the RGB data into the RGBW data, setting an initial scale value to 50% to perform scaling and setting a light level of a backlight corresponding to the initial scale value to 100%, matching the input RGB data and RGBW data to assign converted data values to corresponding RGBW pixels, performing inverse gamma calculations with respect to the gamma shaped non-linear data, performing scaling in accordance with a real scale value corresponding to data stored in a frame memory, and applying data on which scaling is performed to a liquid crystal panel through a data driver.

In some embodiments, the method further includes detecting out of color colors from the converted RGBW data, outputting the backlight level correct signal to control the color mapping and outputting the scale value corresponding to the correct signal when a color is mapped in the out of color area, and receiving the determined backlight level correct signal to control the light of the backlight emitted through a backlight unit to correspond to the correct signal.

BRIEF DESCRIPTION OF THE DRAWINGS

The accompanying drawings, together with the specification, illustrate exemplary embodiments of the present invention, and together with the description, serve to explain the principles of the present invention.

DETAILED DESCRIPTION

Figure 1:
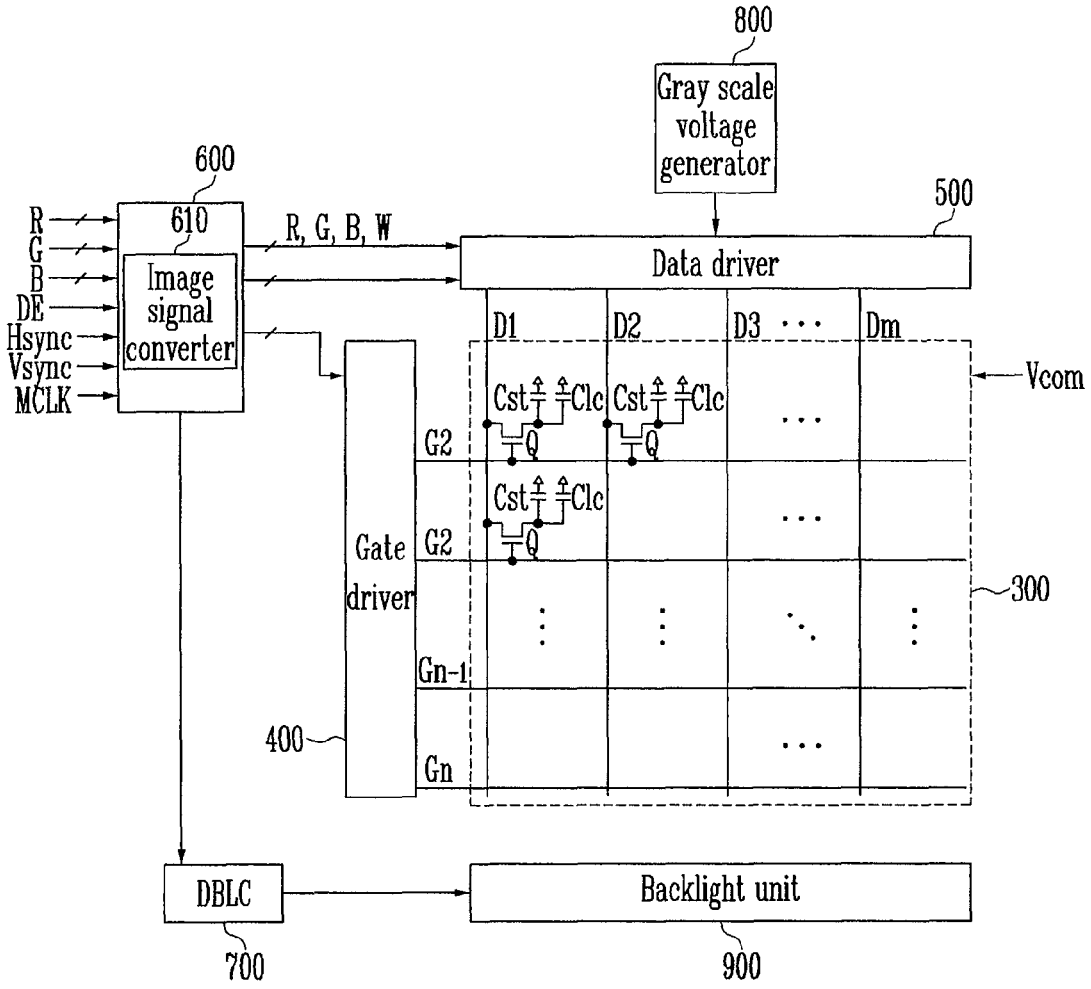
FIG. 1 is a block diagram illustrating the structure of an LCD according to some embodiments of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

An interface method for driving a liquid crystal display (LCD) includes an RGB interface method (or a SYNC interface method) and a CPU interface method.

In the RGB interface method, image data is output in accordance with a frame and a line by timing controls performed by a vertical synchronizing signal VSYNC, a horizontal synchronizing signal HSYNC, and a clock signal. In the RGB interface method, input image data do not pass through an additional memory.

On the other hand, in the CPU interface method, image data is output by timing controls by a register select (RS) signal, a chip select (CS) signal, a write enable signal and a read enable signal. In the CPU interface method, the image data is output to the LCD via a memory (for example, a frame memory).

In addition, since the controller provided in the LCD may support only one of the RGB interface or the CPU interface methods, in description of the embodiments of the present invention, the embodiments driven by the RGB interface method are distinguished from the embodiments driven by the CPU interface method.

Figure 2:
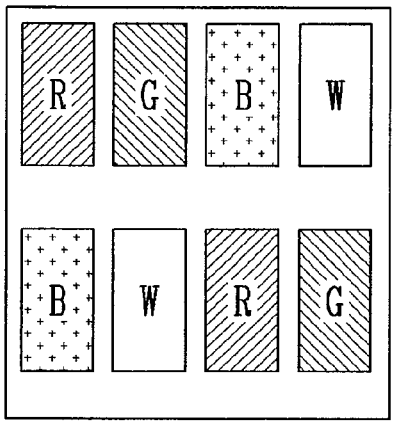
FIG. 2 is a view illustrating the arrangement of the pixels included in FIG. 1.

FIG. 1 is a block diagram illustrating the structure of an LCD according to some embodiments of the present invention. FIG. 2 is a view illustrating the arrangement of the pixels included in FIG. 1.

An LCD driven by the RGB interface method will be described as an example.

Referring to FIG. 1, the LCD includes a liquid crystal panel 300 and a gate driver 400, a data driver 500, a gray level voltage generator 800 coupled to the data driver 500, a backlight unit 900 providing light to the liquid crystal panel 300, a dynamic backlight controller (DBLC) 700 for controlling the backlight unit 900, a gray scale voltage generator 800, coupled to the data driver 500, for generating gray scale voltages, and a controller 600 for controlling the gate driver 400, the data driver 500, and the dynamic backlight controller 700.

The liquid crystal panel 300 includes a plurality of R, G, B, and W pixels provided between a plurality of scan lines G1 to Gn and data lines D1 to Dm arranged in a matrix. Each of the pixels includes a switching element Q coupled to the scan lines and the data lines and a liquid crystal capacitor Clc and a storage capacitor Cst coupled to the switching element. The storage capacitor Cst is optional and may be omitted if necessary.

The R, G, B, and W pixels become one unit pixel, and the R, G, B, and W pixels that constitute the unit pixel are sub pixels of the unit pixel.

In some embodiments, the liquid crystal capacitor uses the pixel electrode provided on the lower substrate and the common electrode provided on the upper substrate as two terminals and the liquid crystal layer formed between the pixel electrode and the common electrode as a dielectric material. In addition, the pixel electrode is coupled to the switching element and the common electrode is formed on the front surface of the upper substrate to receive a common voltage Vcom.

However, the common electrode may be provided on the lower substrate. In this case, the pixel electrode and the common electrode that are linear or rod-shaped are arranged to cross each other.

In addition, each of the pixels includes R, G, and B color filters in a region corresponding to the pixel electrode to realize R, G, B, and W colors. A color filter is not provided in the W pixel. As illustrated in FIG. 2, the R, G, B, and W pixels are sequentially arranged in the mentioned order in an odd row and B, W, R, and G pixels are sequentially arranged in the mentioned order in an even row. Therefore, the R and B pixels are arranged to intersect each other in an odd column and the G and W pixels are arranged to intersect in an even column. Other than such an arrangement method, various other arrangements may be formed. The R, G, B, and W pixels may be arranged in rows and columns so that the same color pixel arrangements are not continuously repeated.

The gray scale voltage generator 800 generates a plurality of gray scale voltages related to the brightness of the LCD. The data driver 500 coupled to the data line of the liquid crystal panel 300 selects the gray scale voltage from the gray scale voltage generator 800 to apply the selected gray scale voltage to a data line as a data signal.

The gate driver 400 coupled to the scan line of the liquid crystal panel 300 applies a gate signal to the scan line.

The backlight unit 900 is provided on the surface corresponding to the lower substrate of the liquid crystal panel 300. According to some embodiments of the present invention, a plurality of LEDs as light sources are included in the backlight unit 900.

The dynamic backlight controller 700 for controlling the driving of the backlight unit 900 controls the amount of the light emitted from the backlight unit 900 to correspond to the data applied to the RGBW pixels to prevent the RGBW picture quality from being deteriorated in the original (pure) color data and to minimize the power consumption of the LCD.

The controller 600 includes an image signal converter 610. However, the image signal converter 610 may be realized by an additional device different from the controller 600 and may exist outside of the controller. The image signal converter 610 converts the RGB data input to the controller into RGBW data to provide the RGBW data to the panel.

The controller 600 receives image signals of three colors of R, G, and B and input control signals, for example, the vertical synchronizing signal VSYNC, the horizontal synchronizing signal HSYNC, a main clock MCLK, and a data enable signal DE a graphic controller (not shown) for controlling the display of the image signals. The signal controller 600 generates a gate control signal and a data control signal based on the input control signals, sends the gate control signal to the gate driver 400, and sends the data control signal to the data driver 500. In addition, the controller 600 applies the control signals to the dynamic backlight controller 700 to control the dynamic backlight controller 700.

That is, the LCD according to some embodiments of the present invention converts the RGB data into the RGBW data through the image signal converter 610 to provide the RGBW data to the panel. The dynamic backlight controller 700 controls the amount of the light emitted from the backlight unit 900 to correspond to the converted RGBW data to prevent the RGBW picture quality from being deteriorated in the pure color data and to minimize the power consumption of the LCD.

Figure 3:
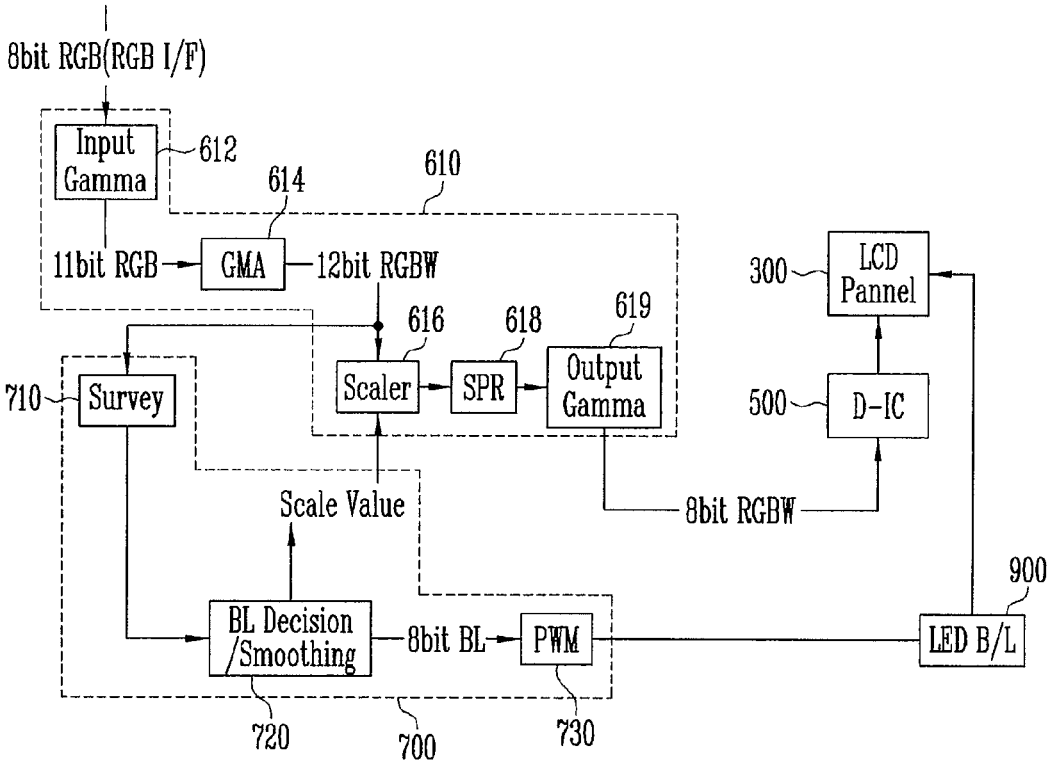
FIG. 3 is a block diagram illustrating the structures of an exemplary image signal converter and dynamic backlight controller, according to some embodiments of the present invention.
Figure 4:
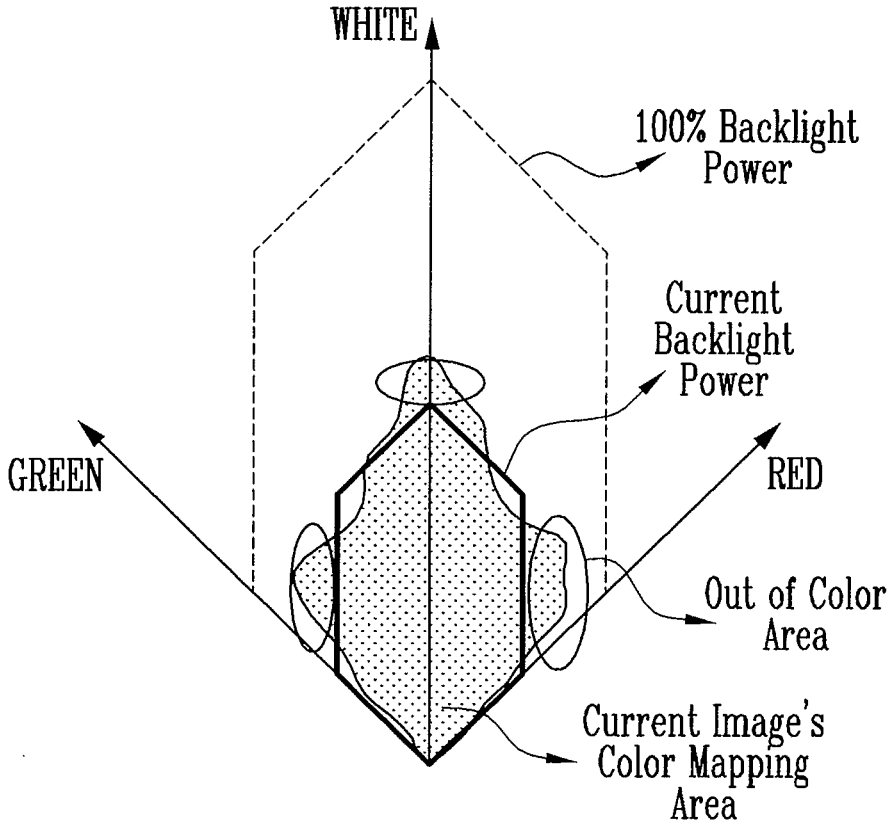
FIG. 4 is an RGBW vector mapping graph in a color vector space.

FIG. 3 is a block diagram illustrating the structures of an exemplary image signal converter and dynamic backlight controller. FIG. 4 is an RGBW vector mapping graph in a color vector space, which describes the amount (level) of the light of the backlight controlled according to some embodiments of the present invention.

Referring to FIG. 3, the image signal converter 610 includes an input gamma processor 612, a gamma mapping algorithm (hereinafter, GMA) unit 614, a scaler 616, a sub pixel rendering (SPR) unit 618, and an output gamma processing unit 619.

The input gamma processing unit 612 processes the linear R, G, and B data (for example, an 8 bit signal) input from the outside into gamma-shaped non-linear data so that the length of the 8 bit R, G, and B data increases to 11 bit R, G, and B data.

The operation of extracting a white (W) value from the 11 bit R, G, and B data is performed by the GMA unit 614. Conversion from the R, G, and B data into the R, G, B, and W data is performed by the gamma mapping algorithm formula provided by the GMA unit 614. When the R, G, and B data are changed into the R, G, B, and W data, the length of the 11 bit R, G, and B data increases by 1 bit. That is, the 11 bit R, G, and B data are converted into 12 bit R, G, B, and W data.

A detailed structure and operation of a GMA unit is disclosed in Korean Patent Publication Nos. 10-2009-0036513 and 10-2009-0040230, the entire contents of which are hereby expressly incorporated by reference.

The converted 12 bit R, G, B, and W data are provided to the DBLC 700 and the DBLC detects "out of color (Gamut) area" colors, as illustrated in FIG. 4.

When conversion of the RGB data into the RGBW data is generated, colors of specific high chroma may deviate in a color area, which is referred to as the output of "out of color (Gamut)". FIG. 4 is an RGBW vector mapping diagram in which white (W) is added to a common RGB vector mapping figure. Referring to FIG. 4, the above-described out of color (Gamut) region is illustrated.

The DBLC 700 includes a data survey unit 710, a BL decision/smoothing unit 720, and a backlight controller (PWM) 730. The data survey unit 710 detects the out of color (Gamut) area colors through the converted 12 bit R, G, B, and W data.

Since there is a white (W) color in the data, a displayable color brightness area may increase in comparison with the LCD consisting of the common R, G, and B pixels (for example, in the case of a high resolution panel no less than 250 ppi).

Therefore, the DBLC 700 outputs a backlight level correct signal when a color is mapped to the region excluding the region displayable in the current backlight light level considering a correlation between the current backlight light level and the color brightness area through the current color brightness mapping to control the color mapping. As a result, the DBLC 700 outputs a re-corrected backlight level correct signal and a scale value. This is performed by the BL decision/smoothing unit 720 of the DBLC 700.

The above is performed by applying a smoothing function that changes the light level of the backlight by a target value from the current value by determining the light level of a target backlight in accordance with the result of detecting colors that deviate from the color area and by minimizing visual artifacts.

In addition, the backlight level correct signal determined by the BL decision/smoothing unit 720 is transmitted to a backlight controller 730 to finally control the backlight unit 900 to correspond to the backlight light level control signal. The scale value is transmitted to the scaler 616 of the image signal converter 610.

When the scale value is calculated, the scaler 616 performs scaling so that the RGBW data value corresponds to the currently re-corrected backlight light value through the scale value.

The RGBW data value re-corrected by the scaler 616 is transmitted to the SPR unit 618 and the SRP unit 618 matches the data on the common RGB pixels arranged in a stripe to the data on the RGBW pixels illustrated in FIG. 2 to assign the properly converted data values to the RGBW pixels.

A detailed structure and operation of a SPR unit is disclosed in Korean Patent Publication Nos. 10-2009-0036513 and 10-2009-0040230, the entire contents of which are hereby expressly incorporated by reference.

Therefore, when the data values applied to the RGBW pixels are determined, the pixel data value (for example, 11 bit) output from the scaler 616 is converted into 10 bit data by the output gamma processing unit 619. The 10 bit data as a data signal dithered by 8 bit data and finally applied to the liquid crystal panel 300 is provided to the data driver 500.

In some embodiments, the output gamma processing unit 619 may be realized by the inversion of the input gamma processing unit 612.

Therefore, as illustrated in FIG. 3, when the RGB image data are initially input, the RGB image data are converted into the RGBW data and the scale value and the value of the light level of the backlight are realized by the DBLC 700.

The DBLC 700 gradually changes the light level of the backlight by the smoothing unit so that human eyes may not recognize the change. The change is determined by the combination of the backlight light level value determined by the currently input image and the current backlight light level value as illustrated in EQUATION 1.

$$Bl=A*BL_t+B*BL_c \quad \text{(EQUATION 1)}$$

where BL is the newly calculated light level of a backlight, BL_t is the light level of a target backlight to be determined, and BL_c is the currently set light level of a backlight.

The combination of such a value is applied based on the weight values of A and B. Therefore, the DBLC observes a change in the current image.

That is, according to the embodiments of FIG. 1, the driving of an LCD driven by the RGB interface method does not change. However, in the case of the LCD driven by the CPU interface method in which a frame memory is to be provided, when the frame memory is positioned between the image signal converter and the data driver illustrated in FIG. 3, the input values of continuous images need to be determined due to the smoothing operation of the DBLC and continuous scale values and backlight light levels in accordance with the input values. However, in the CPU interface method, since the inputting of images is not continuously performed, the operation of the DBLC does not have to be performed smoothly.

That is, since the light level of the backlight of the DBLC is realized after completely receiving the data of one frame in the CPU interface method so that the image to which the complete dynamic backlight control (DBLC) is applied may be output in a second frame, it is difficult to achieve the desired picture quality and low power consumption in the CPU interface method through the structure of FIG. 3.

Therefore, in order to overcome the above difficulty, the frame memory may be positioned immediately before the image signal converter. In this case, the data in the frame memory is continuously read from the previous stage of the frame memory at no less than 60 Hz, so that the DBLC may operate normally.

However, in this case, since it is not possible to obtain the effect of reducing a memory capacity (⅔ frame memory) that may be obtained by converting the RGB pixels into the RGBW pixels and that a full frame memory needs to be accessed and continuously processed, a clock faster than the ⅔ frame memory is needed and therefore the power consumption increases.

Therefore, according to the embodiments of the present invention, in the LCD driven by the CPU interface method, a new structure for performing the operation of the DBLC while using only a ⅔ frame size is provided.

Figure 5:
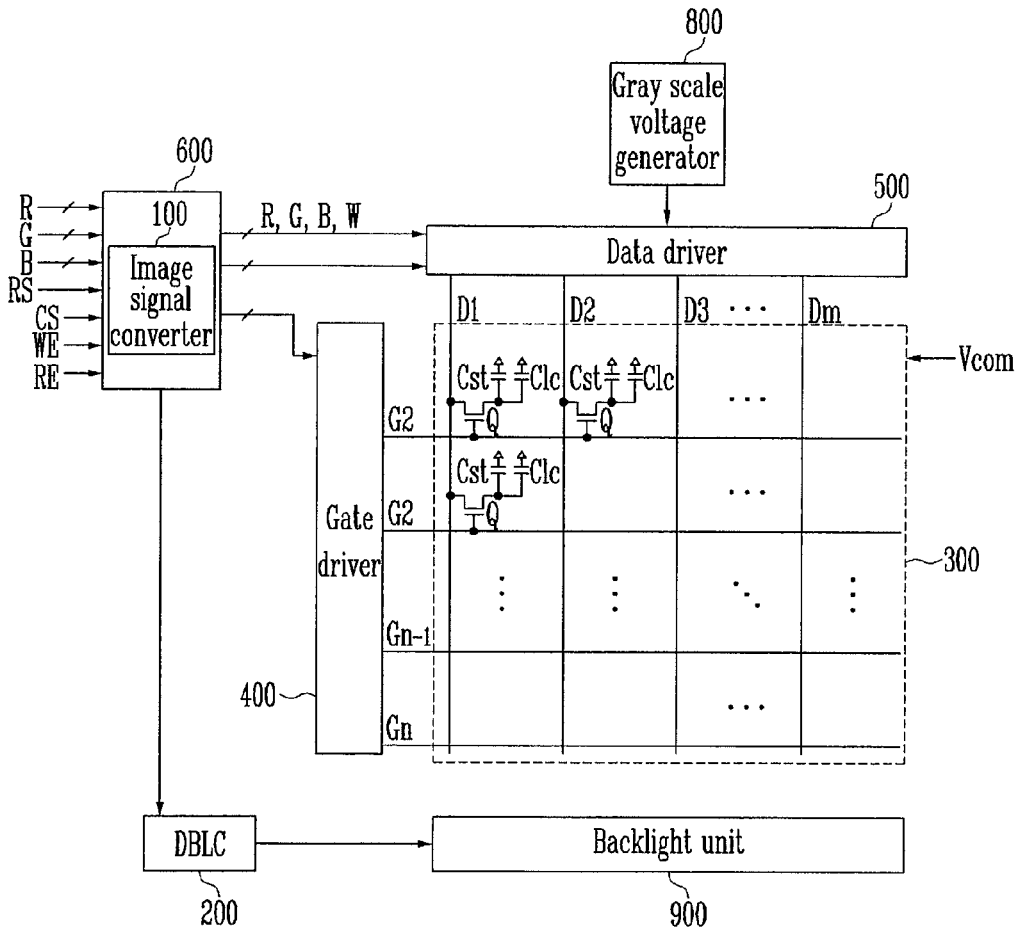
FIG. 5 is a block diagram illustrating the structure of an LCD according to some embodiments of the present invention.

FIG. 5 is a block diagram illustrating the structure of an LCD, according to some embodiments of the present invention.

The LCD driven by the CPU interface method will be described as an example.

Referring to FIG. 5, an LCD according to some embodiments of the present invention includes a liquid crystal panel 300, a gate driver 400, a data driver 500, a gray scale voltage generator 800 coupled to the data driver 500, a backlight unit 900 for providing light to the liquid crystal panel 300, a dynamic backlight controller 200 for controlling the backlight unit, and a controller for controlling the gate driver 400, the data driver 500, and the dynamic backlight controller 200.

When this structure is compared with the embodiments of the above-described RGB interface method, signals input to the controller are different, however, the other structures and operations are the same and thus detailed description thereof will be omitted.

The controller 600 includes an image signal converter 100. The image signal converter 100 may be realized by an additional device different from the controller 600 to exist outside the controller 600 and may convert the RGB data input to the controller into the RGBW data to provide the RGBW data to the panel.

The controller 600 is different from the embodiments of FIG. 1 in receiving images of three colors of R, G, and B and a register select (RS) signal, a chip select (CS) signal, a write enable (WE) signal, and a read enable (RE) signal as input control signals for controlling the display of image data.

The RGB data are converted into the RGBW data through the image signal converter to be provided to the panel. The DBLC controls the amount of light emitted by the backlight unit to correspond to the converted RGBW data to prevent the RGBW picture quality from being deteriorated in the pure color data and to minimize the power consumption of the LCD.

Therefore, the image signal converter 100 is realized to have a different structure as the embodiments illustrated in FIG. 3, which will be described in detail with reference to FIG. 6.

Figure 6:
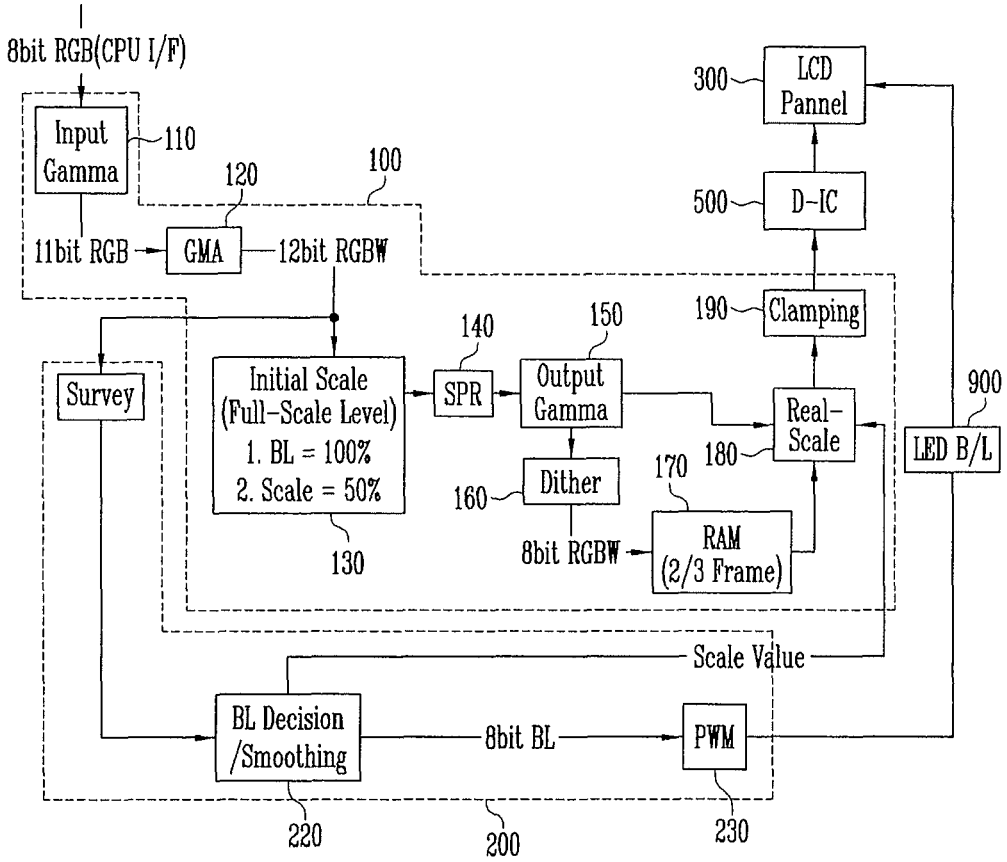
FIG. 6 is a block diagram illustrating the structures of the image signal converter and the dynamic backlight controller of FIG. 5.

FIG. 6 is a block diagram illustrating the structures of an exemplary image signal converter and an exemplary dynamic backlight controller. Referring to FIG. 6, the image signal converter 100 includes an input gamma processing unit 110, a gamma mapping algorithm (GMA) unit 120, an initial scaler 130, a sub pixel rendering (SPR) unit 140, an output gamma processing unit 150, a dithering unit 160, a frame memory (e.g., a RAM) 170, a real scaler 180, and a clamper 190.

As a ⅔ frame buffer, the frame memory 170 is coupled to the output of the dithering unit 160. The initial scaler 130 for executing the initial scale value as specific values are further provided in the image signal converter 100 illustrated in FIG. 6.

In some embodiments, the specific scale value fixed to the initial scale value by the initial scaler 130 is the scale value of 50% in which there is no deterioration of picture quality to correspond to the 100% of light level of the backlight.

That is, when the initial scale value is determined as 50% (0.5) and the light level of the backlight is determined as 100% to correspond to the value, the out of color (Gamut) area colors are not generated on all of the converted data.

Based on the data, the SPR unit 140, the output gamma processing unit 150, and the dithering unit 160 perform their operations, respectively.

The DBLC 200 receives the value output from the GMA unit 120 to determine the optimal backlight light level value with reference to the current frame value and to determine the light level of the backlight for the currently input data and the real scale value by applying a smoothing function using the optimal backlight light level value as a target.

Therefore, the initial frame is output using the data stored in the frame by applying the initial scale. The next frame is re-calculated as the value to which the real scale is applied in accordance with the light level of the backlight and the scale value that are optimal to the data stored in the current frame memory 170.

The out of color (Gamut) colors and the light level of the backlight with respect to the data converted by the GMA 120 of the image signal converter 100 are determined in a previous stage of the frame memory 170. The operation of the scaler 180 to which the real scale value is applied is also performed in the previous stage of the frame memory 170.

In this case, the real scale is applied considering the value converted into the initial scale value.

The real scale is performed by the scaler 180 and is calculated by the following EQUATION 2.

Figures 7, 8:
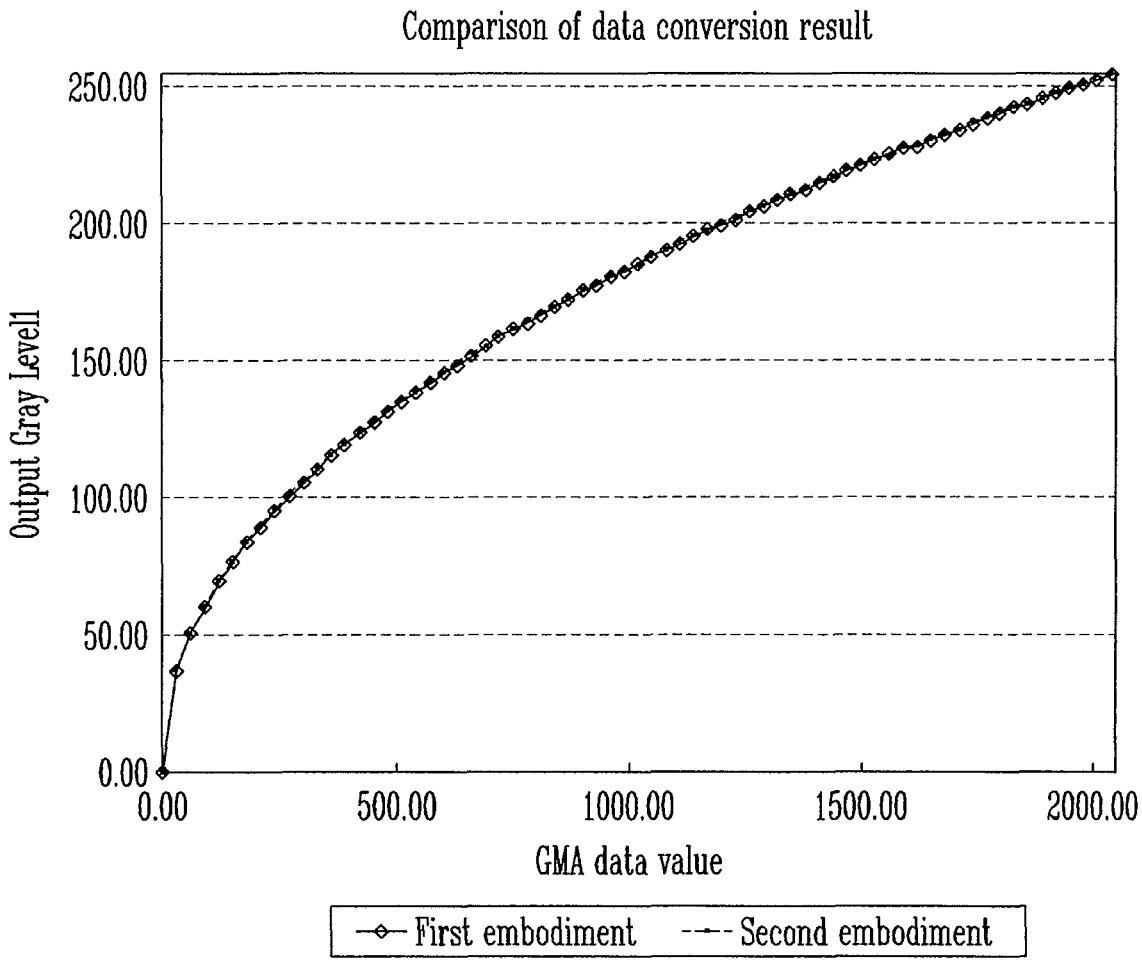
FIG. 7 is a view illustrating the position of a sub pixel when the sub pixel is rendered.
FIG. 8 is a graph of comparing and mapping the data conversion results according to two embodiments of the present invention.

In order to develop the EQUATION 2, the equation of the finally output data on the specific pixel on which sub pixel rendering is performed by the scaler 180 and the SPR unit 140 after passing through the GMA unit 120 will be described as follows (Hereinafter, the value for the color R will be described as an example).

$$R_scale1=R_gma1*c$$

$$R_scale2=R_gma2*c$$

$$R_scale3=R_gma3*c$$

$$R_scale4=R_gma4*c$$

$$R_scale5=R_gma5*c$$

$$R_spr_c1=0.125*R_scale2+0.125*R_scale3+0.125*R_scale5+0.125*R_scale4+0.5*R_scale1-0.125*c*L2-0.125*c*L3-0.125*c*L5-0.125*c*L4+0.5*c*L1=c*(0.125*R_gma2+0.125*R_gma3+0.125*R_gma5+0.125*R_gma4+0.5*R_gma1-0.125*L2-0.125*L3-0.125*L5-0.125*L4+0.5*L1)=c*R_spr1 \quad \text{(EQUATION 2)}$$

where, R_gma1 to R_gma5 illustrate results after the gamma mapping algorithm by the GMA unit of the red color is applied to the 5 sub pixels. The position of each of the sub pixel based on a common RGB stripe with respect to the R color is illustrated in FIG. 7. That is, FIG. 7 is a view illustrating the position of a sub pixel when the sub pixel is rendered. The numbering notation described in FIG. 7 corresponds to the EQUATION 2.

The variables in the EQUATION 2 are defined as follows:

c: value to be scaled,

R_gma: sub pixel data after gamma mapping algorithm by the GMA unit is applied,

R_scale: sub pixel data after being scaled,

R_spr_c: sub pixel rendering result with respect to scaled data,

L: value of calculating the luminance of the current pixel as R, G, B, and W by luminance data, and R_spr: sub pixel rendering result on data that are not scaled Referring to the EQUATION 2, when the sub pixel rendering result value with respect to the data that are not scaled is multiplexed by the scale value, the sub pixel rendering result on the scaled data is calculated.

In addition, the following EQUATIONS 3 and 4 illustrate the functions performed by the output gamma processing unit 150 and the dithering unit 160. The dithering unit 160 uses spatial dither due to the characteristic of the CPU interface, performs round up in the position where round-up is to be performed, and performs 2 bit truncate. The equations are developed taking into account the operation performed by the output gamma processing unit 150, that is, the case in which gamma 2.2 is set as a target in a function liquid crystal panel.

$$R_outgamma1=R_spr_c1\hat{}(1/2.2) \quad \text{(EQUATION 3)}$$

$$R_dither1=R_outgamma1/4 \quad \text{(EQUATION 4)}$$

Therefore, the final value of R_dither1 is displayed as R_spr1 as illustrated in EQUATION 5.

$$R_dither1=[(c*R_spr1)\hat{}(1/2.2)]/4 \quad \text{(EQUATION 5)}$$

In order to obtain the equation of the real-scale value input to the scaler 180 of FIG. 6, the development of the equation of R_dither1 in accordance with the operations of the elements illustrated in FIG. 6 is illustrated in EQUATION 6.

$$R_spr_c1=0.5*R_spr1 \quad \text{(EQUATION 6)}$$

where, the initial scale value is 0.5 and the scale value of 0.5 is calculated considering the above.

Since R-dither1 performs the same processes as the equations 3 and 4, calculation is performed by replacing the equation 6 as illustrated in the following EQUATION 7.

$$R_dither1=[(0.5*R_spr1)\hat{}(1/2.2)]/4 \quad \text{(EQUATION 7)}$$

The compensation value x, that is, the real scale value of FIG. 6 is obtained by the EQUATIONS 7 and 5 as illustrated in the following EQUATION 8 considering the EQUATION 7 so that the result of the equation 7 is the same as the result of the EQUATION 5.

$$x*\{[(0.5*R_spr1)\hat{}(1/2.2)]/4\}=[(c*R_spr1)\hat{}(1/2.2)]/4$$

$$x=(2*c)\hat{}(1/2.2) \quad \text{(EQUATION 8)}$$

Therefore, in FIG. 6, the scaler 180 multiplies the resultant value stored in the frame memory 170 by the resultant value of the EQUATION 8. At this time, the value c becomes the scale value calculated by the DBLC.

Actually, the scale value c calculated by the DBLC 200 is between 0.5 and 2 the calculation result of the value x considering the above is illustrated in the following TABLE 1.

TABLE 1

Calculation of the value x in accordance with the scale value

| C | 0.5 | 1 | 2 |
|---|---|---|---|
| 2*c | 1 | 2 | 4 |
| (2*c)^(1/2.2) | 1 | 1.370350985 | 1.877861821 |

As confirmed by the TABLE 1, since the initial scale value is previously applied as 0.5 when the scale value is 0.5, the value of x is 1 and the value of x increases as the scale value increases to 2. However, the degree of increase increases in proportion to the inverse output gamma value, that is, 1/2.2.

FIG. 8 is a graph for comparing and mapping the data conversion results according to the embodiments of the present invention.

The scale value c is data mapped assuming that the value c is 1.0. When the GMA value changes from 0 to 2047, the finally converted data are calculated.

Referring to FIG. 8, it is confirmed that almost the same result is calculated by the embodiments of FIG. 1 and FIG. 5. During the data conversion by the scaler 180 of FIG. 6, for the correctness of the calculating result of the output gamma of the EQUATION 8, the data substantially instantaneously read from the frame is converted from 8 bit data to 12 bit data, to perform calculation, and to convert the 12 bit data into 8 bit data.

The clamper illustrated in FIG. 6 for performing clamping may be processed the same as that in the conventional art. In the case of the value to be clamped, that is, the pixel in which out of color (Gamut) data are generated, the resultant value is normalized so that the pixel is entirely in color (gamut).

A detailed structure and operation of a clamper is disclosed by the Korean Patent Publication Nos. 10-2009-0036513 and 10-2009-0040230.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A liquid crystal display (LCD) configured to be driven by a CPU interface method, comprising:

a liquid crystal panel including a plurality of R, G, B, and W pixels (RGBW pixels) located between a plurality of scan lines and data lines, arranged in a matrix;

a backlight unit for radiating light onto the liquid crystal panel;

a data driver for applying data signals to the plurality of data lines;

an image signal converter comprising a frame memory, the image signal converter for converting input RGB data into output RGBW data and providing the output RGBW data to the data driver;

a dynamic backlight controller for controlling an amount of light emitted from the backlight unit to correspond to data applied to the RGBW pixels; and an input gamma processing unit for processing linear data input to gamma shaped non-linear data;

a gamma mapping unit for extracting a white value from gamma shaped non-linear RGB data to convert the gamma shaped non-linear RGB data into gamma mapped RGBW data;

an initial scaler for executing an initial scale value to be fixed as a specific scale value;

a sub pixel rendering unit for matching the input RGB data with the output RGBW data to assign converted data values to corresponding RGBW pixels;

an output gamma processing unit for performing an inverse gamma calculation with respect to gamma shaped non-linear RGBW data to output inverse gamma RGBW data;

the frame memory for storing the inverse gamma RGBW data received from the output gamma processing unit, as frame data; and a real scaler for performing scaling in accordance with a real scale value corresponding to the frame data, wherein an amount of memory in the frame memory used to buffer frame data for a whole display of the LCD, is less than an amount of memory required to store all of the frame data for the whole display of the LCD.

2. The LCD as claimed in claim 1, wherein the RGBW pixels are sequentially arranged in an odd row as R, G, B, and W sub-pixels, and wherein the RGBW pixels are sequentially arranged in an even row as B, W, R, and G sub-pixels.

3. The LCD as claimed in claim 1, wherein the specific scale value fixed to the initial scale value by the initial scaler is a scale value of 50% corresponding to a light level of a backlight of 100%.

4. The LCD as claimed in claim 1, wherein the dynamic backlight controller is configured to detect colors deviating from color areas and to determine a light level of the backlight with respect to the gamma mapped RGBW data converted from the gamma mapping unit in a previous stage of the frame memory, and wherein an operation of the real scaler, to which the real scale value is applied, is performed before the frame memory.

5. The LCD as claimed in claim 1, wherein the dynamic backlight controller comprises:

a data testing unit for detecting colors deviating from color areas by the gamma mapped RGBW data;

a BL decision/smoothing unit for outputting a backlight level correct signal to control the color mapping and outputting the real scale value corresponding to the backlight level correct signal when colors are mapped in the out of color areas; and a backlight controller for receiving the backlight level correct signal determined by the BL decision/smoothing unit to control the backlight unit to correspond to the backlight level correct signal.

6. The LCD as claimed in claim 5, wherein the real scale value is input to the real scaler of the image signal converter.

7. The LCD as claimed in claim 1, wherein the input RGB data comprises the linear data;

the gamma shaped non-linear data comprises the gamma shaped non-linear RGB data;

the initial scaler is configured to scale the gamma mapped RGBW data according the initial scale value to output initial scaled RGBW data;

the sub pixel rendering unit is configured to render the initial scaled RGBW data into the converted data values;

the output gamma processing unit is configured to process the converted data values into the inverse gamma RGBW data; and the real scaler is configured to scale the inverse gamma RGBW data stored as the frame data into the output RGBW data.

8. The LCD as claimed in claim 7, wherein the image signal converter further comprises:

a dithering unit configured to dither the inverse gamma RGBW data before it is stored as the frame data.

9. The LCD as claimed in claim 7, wherein the image signal converter further comprises:

a clamper configured to clamp the output RGBW data before it is provided to the data driver.

10. The LCD as claimed in claim 1, wherein the image signal converter further comprises:

an output gamma processing unit for performing an inverse gamma calculation with respect to gamma shaped non-linear RGBW data to output inverse gamma RGBW data; and the frame memory for storing the inverse gamma RGBW data as the frame data.

11. A method of driving an LCD driven by a CPU interface method, comprising:

processing linear RGB data input to generate gamma shaped non-linear data;

extracting a white value from the gamma shaped non-linear data to convert the RGB data into converted RGBW data;

setting an initial scale value to substantially 50% to perform scaling and setting a light level of a backlight corresponding to the initial scale value to substantially 100%;

matching the input RGB data and the RGBW data to assign converted data values to respective RGBW pixels;

performing inverse gamma calculations with respect to the gamma shaped non-linear data;

providing the gamma shaped non-linear data to a frame memory;

performing scaling in accordance with a real scale value corresponding to frame data stored in the frame memory; and applying RGBW output data on which scaling is performed to a liquid crystal panel through a data driver, wherein an amount of memory in the frame memory used to buffer frame data for a whole display of the LCD, is less than an amount of memory required to store all of the frame data for the whole display of the LCD.

12. The method as claimed in claim 11, further comprising:

detecting out of color colors from the converted RGBW data;

outputting a backlight level correct signal to control the color mapping and outputting the real scale value corresponding to the backlight level correct signal when a color is mapped in the out of color area; and receiving the determined backlight level correct signal to control the light level of the backlight emitted by a backlight unit to correspond to the backlight level correct signal.

13. The method as claimed in claim 11, further comprising:

scaling the converted RGBW data into initial scaled RGBW data according to the initial scale value;

render the initial scaled data into the converted data values;

performing the inverse gamma calculations on the converted data values to generate inverse gamma RGBW data; and storing the inverse gamma RGBW data in the frame memory as the frame data.

* * * * *